US006978487B2

(12) United States Patent
Abraham

(10) Patent No.: US 6,978,487 B2
(45) **Date of Patent: *Dec. 27, 2005**

(54) APPARATUS FOR ENHANCING ABSORPTION AND DISSIPATION OF IMPACT FORCES FOR SWEATBANDS USED IN CONNECTION WITH HELMETS

(76) Inventor: Carl J. Abraham, 3 Baker Hill Rd., Great Neck, NY (US) 11023

( * ) Notice: Subject to any disclaimer, the term of this patent is extended or adjusted under 35 U.S.C. 154(b) by 0 days.

This patent is subject to a terminal disclaimer.

(21) Appl. No.: 10/457,856

(22) Filed: Jun. 10, 2003

(65) Prior Publication Data

US 2005/0044611 A1 Mar. 3, 2005

(51) Int. Cl.[7] ..... A63B 71/10

(52) U.S. Cl. ..... 2/425; 2/181; 2/411; 2/DIG. 2; 2/DIG. 11

(58) Field of Search ..... 2/425, 411, 181, 2/DIG. 11, DIG. 2

(56) References Cited

U.S. PATENT DOCUMENTS

| | | | | | |
|---|---|---|---|---|---|
| 1,434,854 | A | * | 11/1922 | Stall | 2/171 |
| 4,613,993 | A | | 9/1986 | Steele | 2/411 |
| 4,896,378 | A | | 1/1990 | Campana | 2/170 |
| 4,910,804 | A | * | 3/1990 | Lidgren | 2/209.3 |
| 4,947,488 | A | | 8/1990 | Ashinoff | 2/181 |
| 5,175,887 | A | | 1/1993 | Kim | 2/174 |
| 5,329,638 | A | | 7/1994 | Hansen | 2/16 |
| 5,337,420 | A | * | 8/1994 | Haysom et al. | 2/410 |
| 5,930,841 | A | | 8/1999 | Lampe | 2/411 |
| 5,946,734 | A | * | 9/1999 | Vogan | 2/412 |
| 5,963,989 | A | * | 10/1999 | Robertson | 2/411 |
| 6,000,062 | A | | 12/1999 | Trakh | 2/171 |
| 6,247,181 | B1 | * | 6/2001 | Hirsch et al. | 2/207 |
| 6,266,827 | B1 | * | 7/2001 | Lampe et al. | 2/414 |
| 6,349,416 | B1 | | 2/2002 | Lampe | 2/411 |
| 6,397,399 | B1 | * | 6/2002 | Lampe et al. | 2/425 |
| 6,438,761 | B1 | * | 8/2002 | McGarrity | 2/410 |
| 2002/0189004 | A1 | * | 12/2002 | Aaron | 2/411 |

* cited by examiner

*Primary Examiner*—Rodney M. Lindsey

(57) ABSTRACT

A sweatband designed to be worn on the head of a user under a pre-existing helmet, for usage in a variety of sporting activities. Due to the presence of an additional layer beneath the helmet, it takes additional time for impact forces to reach the user's head, thus providing greater protection. In the preferred mode, the device comprises a generally tubular "horizontal" sweatband portion, much like a typical headband. In an enhanced mode, the horizontal member is affixed to a "vertical" portion that is perpendicular to the horizontal portion, extending from the user's forehead, over the crown of the head, and to the back of the head. In still another embodiment, three such bands are utilized for maximum coverage of critical areas of the head. The sweatband of the present invention comprises inserts for the purpose of protecting the user, which may be permanently placed or removable. In the preferred mode, the inserts are polymeric and function to absorb and dissipate impact forces with which the user's head comes in contact. Importantly, the inserts may be strategically placed within the sweatband, such as in the areas most vulnerable to concussion or injury upon impact. In addition, the polymeric inserts may be removed from the sweatband so that the sweatband may be conveniently washed. In total, the invention provides a novel, lightweight means to protect the head of the athlete, while effectively functioning to absorb perspiration.

10 Claims, 2 Drawing Sheets

APPARATUS FOR ENHANCING ABSORPTION AND DISSIPATION OF IMPACT FORCES FOR SWEATBANDS USED IN CONNECTION WITH HELMETS

BACKGROUND OF THE INVENTION

1. Field of the Invention

The present invention is a sweatband designed to be worn on the head of a user under a pre-existing helmet, for usage in a variety of sporting activities. Due to the presence of an additional layer beneath the helmet, it takes additional time for impact forces to reach the user's head, thus providing greater protection. In the preferred mode, the device comprises a generally tubular "horizontal" sweatband portion, much like a typical headband. In an enhanced mode, the horizontal member is affixed to a "vertical" portion that is perpendicular to the horizontal portion, extending from the user's forehead, over the crown of the head, and to the back of the head. In still another embodiment, three such bands are utilized for maximum coverage of critical areas of the head.

The sweatband of the present invention comprises inserts for the purpose of protecting the user, which may be permanently placed or removable. In the preferred mode, the inserts are polymeric and function to absorb and dissipate impact forces with which the user's head comes in contact. Importantly, the inserts may be strategically placed within the sweatband, such as in the areas most vulnerable to concussion or injury upon impact. In addition, the polymeric inserts may be removed from the sweatband so that the sweatband may be conveniently washed. The sweatband may also be washed with the inserts therein. In total, the invention provides a novel, lightweight means to protect the head of the athlete, while effectively functioning to absorb perspiration.

2. Description of the Prior Art

Numerous innovations for protective devices have been provided in the prior art that are described as follows. Even though these innovations may be suitable for the specific individual purposes to which they address, they differ from the present invention as hereinafter contrasted. The following is a summary of those prior art patents most relevant to the invention at hand, as well a description outlining the differences between the features of the present invention and those of the prior art.

1. U.S. Pat. No. 6,000,062, invented by Trakh, entitled "Protective Headband For Soccer Players"

The patent to Trakh describes improved head protection for soccer players comprising a headband formed of resilient material which may be worn alone or inside a conventional soccer helmet to cushion the effects of impacts to the head, especially for children in their formative years.

2. U.S. Pat. No. 4,613,993, invented by Steele et al., entitled "Protective Head Gear With Tubular Rings"

The Steele et al. invention describes protective head gear comprising a plurality of concentric tubular rings formed of soft, yieldable material. The rings which are filled with non-flamable, light, yieldable material, are gradually reduced diametrically and joined by flexible ribbons. A chin strap and a rear support strap detachably maintain the rings on the head of the user.

3. U.S. Pat. No. 5,930,841, invented by Lampe et al., entitled "Soccer Headguard"

The Lampe et al. invention relates to an improved headguard for athletes and in particular soccer players. In accordance with one embodiment of the invention, a headguard is provided which includes a headcover and an adjustable head strap disposed on a perimeter of the head for drawing sections of the headcover together. The headcover includes padding having at least a front portion and a top portion and also includes a flexing section. The flexing section of the headcover is positioned such that, when the head strap is adjusted, at least a portion of the headcover flexes at the flexing section to generally conform to at least a portion of the head of a wearer.

4. U.S. Pat. No. 6,349,416, invented by Lampe et al., entitled "Headguard-Protective Sports Headband"

The patent to Lampe et al. describes a protective headguard to be worn by an athlete having a protective central pad, a rear pad, an adjustable strap system interconnecting the rear pad and the central pad, and one or more of a lack of any protective padding which would cover the side of the athlete's head when the headguard is worn, a channel defined by the central pad extending substantially horizontally above the athlete's brow ridges and below the athlete's frontal bone when the headguard is worn, a slot in the rear pad extending substantially vertically from the athlete's occipital bone and accommodating passage of a ponytail when the headguard is worn, a single unitary liner, bands encircling the central pad and releasably securing a liner to the central pad, a removable sleeve, a spine pad extending from the front panel to the rear pad perceptible lines of demarcation on the exterior surface of the central pad.

5. U.S. Pat. No. 6,247,181, invented by Hirsch et al., entitled "Bandana-Head Protector Using Fabric And Closed Cell Foam"

The Hirsch et al. invention provides a device designed to reduce head injuries among soccer players, and others who would not otherwise wear head protection. It integrates closed-cell foam padding into a traditional bandana form. Foam padding is sewn between layers of fabric in positions which will provide a degree of protection from rotational forces and from direct blows to the forehead, sides, and top of the head.

6. U.S. Pat. No. 4,896,378, invented by Campana, entitled "Protective Wrist Band"

The patent to Campana describes a protective wrist band having a composite body adapted to extend around a wearer's wrist and having complementary connector means on opposite ends for releasably holding the band around the wrist. The wrist band body has an inner layer of a porous, absorbent, fabric material and a thicker shock-absorbing outer layer of a resilient, fluid-impervious, rubber-like closed cell material.

7. U.S. Pat. No. 5,329,638, invented by Hansen et al., entitled "Protective Wristband"

The patent Hansen et al. describes a protective wristband with integrally woven inner and outer layers of an absorbent stretchable material to provide an endless hollow interior, and a cushioned shield disposed between the layers such that the shield is concealed to provide the appearance of a conventional, unprotective wristband.

8. U.S. Pat. No. 5,175,887, invented by Kim, entitled "Absorbent Headband"

In the patent to Kim, an absorbent headband is provided which includes a resilient inner frame and one or more absorbent outer covers. The outer cover is generally tubular, and closed at each end. The outer cover is provided with a slot for removably inserting the inner frame member into the interior of the outer cover. A method is provided for absorbing perspiration which includes the steps of providing a resilient inner member which is generally u-shaped, providing a tubular outer cover, inserting the inner member into the outer cover, and placing the headband on the head of the wearer.

9. U.S. Pat. No. 4,947,488, invented by Ashinoff, entitled "Forehead Guard"

The Ashinoff invention describes a forehead guard consisting of a closed loop of a terrycloth or similar stretch material tube and an unattached semi-circular plastic shock-absorbing member within the tube adapted to assume a forehead position on the user while the terrycloth tube is stretched about the back of the user's head to complete the positioning thereof.

The sweatbands of the prior art generally illustrate wide sweatbands without inserts, lightweight helmets with multiple open areas, head protecting items in the style of bandanas, forehead protective plates, and protective wrist bands.

In contrast, the present invention is a sweatband utilized in conjunction with a helmet, that comprises removable foam or polymeric inserts which function to absorb and dissipate impact forces. Due to the presence of an additional layer beneath the helmet, it takes additional time for impact forces to reach the user's head, thus providing greater protection. Moreover, the open spaces provided by the design allow for an additional dimension of protection, as impact forces must travel additional distances to reach the user's head. As such, the spreading of forces allows the present invention to provide significantly greater absorption and dissipation that the prior art.

Furthermore, the inserts aforementioned are placed within the sweatband in areas most vulnerable to concussion or injury. The inserts may also be removed so that both the inserts and sweatband may be conveniently washed. The sweatbands may also be washed with the inserts permanently in place. Therefore, the invention provides a novel means to better protect the head of the athlete, while effectively functioning to absorb perspiration.

SUMMARY OF THE INVENTION

The present invention is an improved, protective sweatband designed to be worn on the head of a user in conjunction with a previously-existing helmet for optimal protection. The device is suitable for usage in connection with a host of sporting activities, including football, hockey, lacrosse, cycling, skateboarding, and many other applications.

In the preferred mode of manufacture, the device of the present invention comprises a "horizontal" sweatband portion, much like a typical headband, which includes a plurality of apertures for the insertion of protective material such as foam padding or a semi-rigid insert, within a generally tubular perspiration-absorbing fabric. Ends of the tubular band are joined with one another via means selected from the group consisting of snaps, hook and loop fasteners, or buttons to effectively contain the insert(s) and provide a secure fit for the user. Alternatively, the ends of the band may be permanently affixed to one another by being sewn together.

In an enhanced mode, the horizontal sweatband may be affixed to a "vertical" portion, in a cross pattern configuration, perpendicular to the horizontal portion. As such, the vertical portion extends from the user's forehead, over the crown of the head to the back of the head, also including apertures for insertion of protective inserts to provide additional protection.

In still another embodiment, a total of,three such bands are utilized for maximum coverage of critical areas of the head. In any instance, the sweatband of the present invention functions to effectively absorb perspiration in the traditional sense, as well as provide an appropriate level of ventilation and breathing, reducing heat in the process. The sweatband is also expandable, much in the manner of a traditional headband.

Due to the presence of an additional layer beneath the helmet, it takes additional time for impact forces to reach the user's head, thus providing greater protection.

Moreover, the open spaces provided by the design allow for an additional dimension of protection, as impact forces must travel additional distances to reach the user's head. As such, the spreading of forces allows the present invention to provide significantly greater absorption and dissipation that the prior art.

In addition, the sweatband comprises removable polymeric inserts for the purpose of protecting the user. This provides the user with the option of utilizing only the sweatband portion beneath the helmet, if desired. As noted, the inserts are either foam-like or polymeric, functioning to absorb and dissipate impact forces with which the user's head comes in contact. Studies have shown that properly-placed foam padding may reduce impact forces by better than fifty percent.

Importantly, the inserts may be of a variety of widths, and may be strategically placed within the sweatband, such as in the areas most vulnerable to concussion or injury upon impact. As such, a three to five inch curved section of padding material is located in the forehead area in the preferred mode of manufacture.

Precise placement of the appropriate forehead protective insert is significant in reducing the incidence of concussion and other injury, and is particularly important with regard to children who may be inexperienced in playing the sport in question, rendering more susceptible to collisions. Such necessitates usage of the present invention, which provides a lightweight and non-burdensome means to absorb and dissipate a substantial portion of the impact forces associated with collisions.

Young children dashing around a playing field can bash their heads together, get kicked in the head, experience player-to-player contact, have their heads hit the ground, come in contact with a goal post, or inadvertently get hit in the forehead area with the ball.

The Consumer Product Safety Commission has recently raised awareness regarding the risk of concussion from head injuries. Moreover, the risk of sustaining a concussion is especially high for children. Accordingly, the frontal forehead and temporal area must be protected better than any other area. Although it may not prevent it, the present invention reduces the incidence of concussion.

Second concussions are particularly damaging when players have yet to fully recover from first concussions. It should also be noted that many children engage in physical play in which elbows commonly strike the head in the forehead area. Frequently, children do not fully recover from such concussions. The present invention also serves to mitigate the incidence of cuts and bruises associated with such collisions.

With regard to the enhanced embodiments of the present invention, the crown of the head may be protected by a relatively small protective insert, such as a curved two inch piece of foam or semi-rigid polymer.

Regarding the practicality of the invention, the polymeric inserts may be removed from the sweatband so that both the sweatband and inserts maybe conveniently washed. The sweatband may also be washed with the inserts in place, if desired. Moreover, the invention uniquely acts as a two-sided sweatband. When one side is wet, the reverse side can then be used, allowing the wet side to dry. Thus, in total, the invention provides a novel means to further protect the head of the athlete, while effectively functioning to absorb perspiration.

Moreover, the present invention may be manufactured in a variety of sizes, so as to render the benefits of same available to athletes of all ages.

Likewise, in order to render the sweatband effective for usage in a variety of applications, both the insert and sweatband itself may be of a variety of widths, tailored to the portion of the head intended to be protected by same. A varying quantity of foam or semi-rigid inserts may also be utilized, depending upon the sport for which the sweatband is intended to be used.

In summation, in light of the foregoing, it is an object of the present invention to provide protective sweatbands that are used in conjunction with protective helmets by players of many sports, including children.

It is a further object of the invention to provide protective sweatbands that are lightweight, cool and comfortable to wear and use, and relatively inexpensive to manufacture.

It is an additional object of the invention to provide protective sweatbands that provides significantly greater absorption and dissipation of impact forces due to the presence of an additional layer of protection, and due to the open spaces in the design.

It is another object of the invention to provide sweatbands that are manufactured in a variety of previously determined sizes.

Finally, another object of the invention is to provide sweatbands with protective inserts that may be easily removed for washing purposes. The sweatbands may also be washed with the inserts permanently in place.

The novel features which are considered characteristic for the invention are set forth in the appended claims. The invention itself, however, both as to its construction and its method of operation, together with additional objects and advantages thereof, will be best understood from the following description of the embodiments when read and understood in connection with accompanying drawings.

BRIEF DESCRIPTION OF PREFERRED EMBODIMENTS

DETAILED DESCRIPTION OF THE PREFERRED EMBODIMENT

Figure 1:
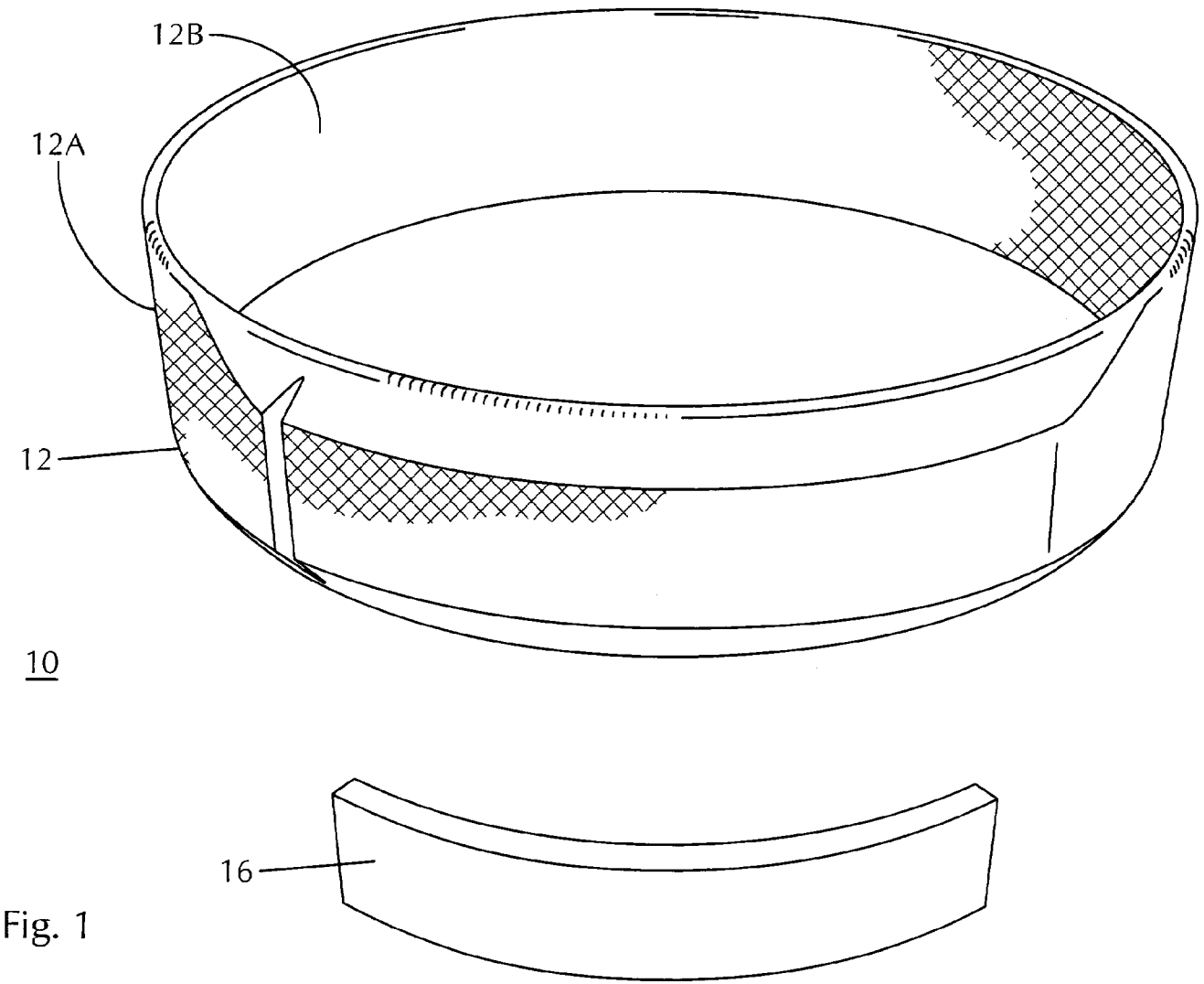
FIG. 1 is a front perspective view of the sweatband of the present invention, indicating general size and configuration of the foam or polymeric protective insert therefor.

FIG. 1 is a front perspective view of the sweatband of the present invention, indicating general size and configuration of the foam or polymeric protective insert therefor. Specifically, sweatband (12) is manufactured of soft and pliable fabric or materials, much like traditional sweatbands and headbands. The sweatband (12) comprises an exterior portion (12A) and interior portion (12B).

Insert (16) is placed within the sweatband (12) through at least one aperture, which may be located either upon the exterior surface of the band (12A) for convenience and easy access, or, alternatively may be located upon the interior surface (12B) to maintain an aesthetically-pleasing appearance. Insert (16) is relatively thin in nature, and may be in the form of foam padding or a semi-rigid, pliable polymer.

Thus, in the preferred mode, the device is a "horizontal" sweatband portion, much like a typical headband. This provides a protective device that is of a familiar shape to the user, and is easy to both put on and remove. Furthermore, the device keeps the user cool during play, while providing significantly more protection in the critical area of the forehead than achieved through usage of conventional sweatbands.

Figure 2:
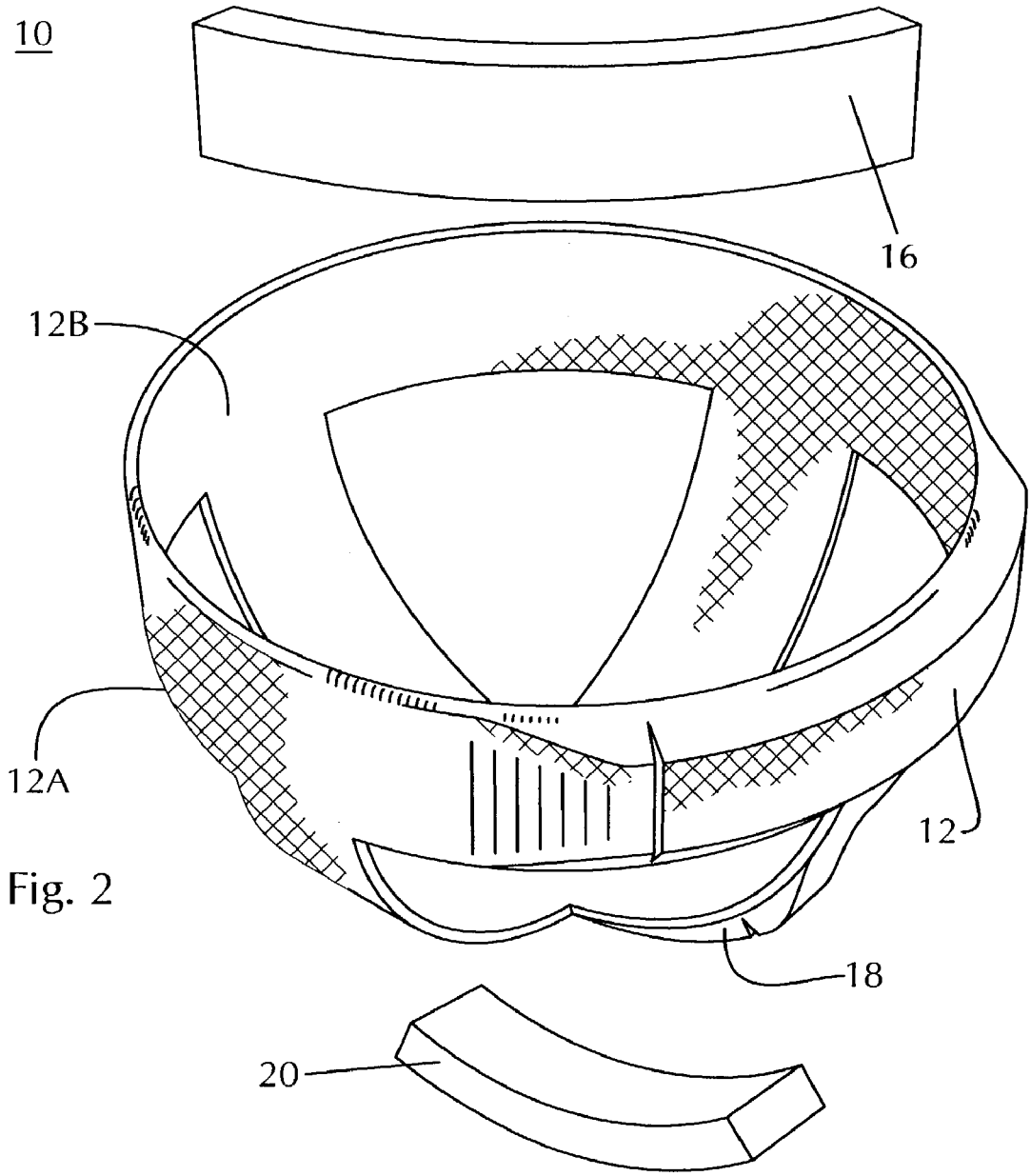
FIG. 2 is a front perspective view of an alternate embodiment of the sweatband of the present invention, illustrating both horizontal and vertical sweatband members, and indicating general size and configuration of the foam or polymeric protective inserts therefor.

FIG. 2 is a front perspective view of an alternate embodiment of the sweatband of the present invention, illustrating both horizontal and vertical sweatband members, and indicating general size and configuration of the foam or polymeric protective inserts therefor. Once again, sweatband (12) comprises an exterior portion (12A) and interior portion (12B). Insert (16) is placed within the sweatband (12) through at least one aperture, which may be located either upon the exterior surface of the band for convenience and easy access, or, alternatively may be located upon the interior surface to maintain an aesthetically-pleasing appearance.

In the enhanced mode, the horizontal member is affixed to a "vertical" portion that is perpendicular to the horizontal portion, extending from the user's forehead, over the crown of the head, and to the back of the head. This provides additional protection to the user, as the insert located at the crown of the head also functions to effective absorb and dissipate impact forces in the event inadvertent contact is made with another player, ball or object.

In a further enhanced mode, the horizontal member is affixed to a "vertical" portion that is perpendicular to the horizontal portion, extending from the user's forehead, over the crown of the head, and to the back of the head, and is also affixed to a second vertical portion that crosses the first vertical portion, extending from a first side, over the crown of the head, and to a second side of the head. This provides still more protection to the user, as the additional band functions to effectively absorb and dissipate even more impact forces in the event contact is made with another player, ball or object.

Importantly, the open spaces provided by the design allow for an additional dimension of protection, as impact forces must travel additional distances to reach the user's head. As such, the spreading of forces allows the present invention to provide significantly greater absorption and dissipation that the prior art.

In any instance, the sweatband of the present invention comprises removable inserts for the purpose of protecting the user. In the preferred mode, the inserts are polymeric and function to absorb and dissipate impact forces with which the user's head comes in contact. Importantly, the inserts may be strategically placed within the sweatband, such as in the areas most vulnerable to concussion or injury upon impact. In addition, the polymeric inserts may be removed from the sweatband so that the sweatband may be conveniently washed, or the sweatband may be washed with the inserts in place. In total, the invention provides an enhanced means to protect the head of the athlete, while effectively functioning to absorb perspiration.

In relation to any embodiment, the insert may be manufactured of a polyethylene or semi-rigid material, polyurethane, or a combination of polymeric materials that have memory. The thickness of the insert may vary according to need, but in all instances, the insert functions to significantly improve the absorption and dissipation of primary forces to better protect the user.

In all such cases, the sweatbands may be manufactured in a variety of previously-determined sizes, functioning to render same effective for multiple persons.

With regards to all descriptions and graphics, while the invention has been illustrated and described as embodied, it is not intended to be limited to the details shown, since it will be understood that various omissions, modifications, substitutions and changes in the forms and details of the device illustrated and in its operation can be made by those skilled in the art without departing in any way from the spirit of the invention.

Without further analysis, the foregoing will so fully reveal the gist of the present invention that others can readily adapt it for various applications without omitting features that, from the standpoint of prior art, constitute essential characteristics of the generic or specific aspects of this invention. What is claimed as new and desired to be protected by Letters Patent is set forth in the appended claims.

What is claimed is:

1. An apparatus for enhancing absorption and dissipation of forces for sweatbands used in connection with helmets comprising:

a soft, pliable sweatband of a generally annular configuration, the sweatband comprising an exterior portion and interior portion, at least one insert removably placed within the sweatband through at least one aperture located on an interior of the sweatband, the insert relatively thin in nature and positioned to protect the forehead area of a user, the insert curved in configuration and of a length in the range of one to three inches, the sweatband reversible, functioning to allow the interior portion to dry while the exterior portion is placed against the head of the user;

the apparatus functioning to absorb and dissipate impact forces, with only remaining forces distributed to the user.

2. The improved protective apparatus as described in claim 1, wherein the insert is a soft, pliable padding material with consistent memory.

3. The improved protective apparatus as described in claim 1, wherein the insert is a semi-rigid polymeric material.

4. The improved protective headgear apparatus as described in claim 3, wherein the polymeric material is selected from the group consisting of polyurethane, a combination of polymers, and a combination of co-polymers.

5. The improved protective apparatus as described in claim 1, wherein the insert can be removed and washed.

6. The improved protective apparatus as described in claim 1, wherein the sweatband may be washed with the insert permanently in place.

7. The apparatus of claim 1 wherein an insert is permanently placed within the sweatband.

8. The apparatus of claim 1 wherein an insert is removably placed within the sweatband.

9. An apparatus for enhancing absorption and dissipation of forces for sweatbands used in connection with helmets comprising:

a soft, pliable horizontal sweatband of a generally annular configuration, the horizontal sweatband comprising an exterior portion and interior portion and designed to be placed around the head of a user, from the forehead to back of the head, at least one insert removably placed within the horizontal sweatband through at least one aperture on the horizontal sweatband, the insert relatively thin in nature and positioned to protect the forehead area of a user, the insert curved in configuration and of a length in the range of one to three inches, and a soft, pliable vertical sweatband affixed to the horizontal sweatband, the vertical sweatband comprising an exterior portion and interior portion and designed to extend from the user's forehead over the crown of the head, and to the back of the head, at least one insert removably placed within the sweatband through at least one aperture on the sweatband, the insert relatively thin in nature and positioned to protect at least one additional area of the head, the insert curved in configuration and of a length in the range of one to three inches, the apparatus functioning to absorb and dissipate impact forces, with only remaining forces distributed to the user.

10. An apparatus for enhancing absorption and dissipation of forces for sweatbands used in connection with helmets comprising:

a soft, pliable horizontal sweatband of a generally annular configuration, the horizontal sweatband comprising an exterior portion and interior portion and designed to be placed around the head of a user, from the forehead to back of the head, at least one insert removably placed within the horizontal sweatband through at least one aperture on the horizontal sweatband, the insert relatively thin in nature and positioned to protect the forehead area of a user, the insert curved in configuration and of a length in the range of one to three inches, a soft, pliable first vertical sweatband affixed to the horizontal sweatband, the first vertical sweatband comprising an exterior portion and interior portion and designed to extend from the user's forehead over the crown of the head, and to the back of the head, at least one insert placed within the sweatband through at least one aperture on the sweatband, the insert relatively thin in nature and positioned to protect at least one additional area of the head, a soft, pliable second vertical sweatband affixed to the horizontal sweatband, the second vertical sweatband comprising an exterior portion and interior portion and designed to extend from a first side of the user's head over the crown of the head, and to a second side of the user's head, at least one insert removably placed within the sweatband through at least one aperture on the sweatband, the insert relatively thin in nature and positioned to protect at least one additional area of the head, the insert curved in configuration and of a length in the range of one to three inches, the apparatus functioning to absorb and dissipate impact forces, with only remaining forces distributed to the user.

* * * * *

UNITED STATES PATENT AND TRADEMARK OFFICE

CERTIFICATE OF CORRECTION

PATENT NO. : 6,978,487 B2
APPLICATION NO. : 10/457856
DATED : December 27, 2005
INVENTOR(S) : Carl J. Abraham It is certified that error appears in the above-identified patent and that said Letters Patent is hereby corrected as shown below:

Title page, item [60] should read as follows:

Continuation-in-part of application No. 10/225,866, filed on August 22, 2002, now Patent No. 6,675,395

Signed and Sealed this

Twenty-fourth Day of November, 2009

David J. Kappos

David J. Kappos
*Director of the United States Patent and Trademark Office*